US007380893B2

(12) United States Patent
Burigana et al.

(10) Patent No.: US 7,380,893 B2
(45) Date of Patent: Jun. 3, 2008

(54) CABINET PARTICULARLY FOR FIREARMS

(75) Inventors: Lucio Burigana, Roveredo In Piano (IT); Marco Gaudenzi, Tavullia (IT)

(73) Assignee: Benelli Armi, S.p.A., Urbino (Bresco) (IT)

( * ) Notice: Subject to any disclaimer, the term of this patent is extended or adjusted under 35 U.S.C. 154(b) by 247 days.

(21) Appl. No.: 11/107,355

(22) Filed: Apr. 15, 2005

(65) Prior Publication Data

US 2005/0248244 A1 Nov. 10, 2005

(30) Foreign Application Priority Data

May 4, 2004 (IT) ..... MI2004A0888

(51) Int. Cl.
*A47B 97/00* (2006.01)

(52) U.S. Cl. ..... 312/310

(58) Field of Classification Search ..... 312/310, 312/291, 292, 351.1, 351.2, 311, 119, 123, 312/271, 201, 202; 206/6.1, 315.11, 317
See application file for complete search history.

(56) References Cited

U.S. PATENT DOCUMENTS 1,749,686 A * 3/1930 Agazzi ..... 312/225
2,631,915 A 3/1953 Wintersteen
3,512,859 A 5/1970 Barroero
3,680,936 A * 8/1972 Backhaus ..... 312/7.1
4,324,446 A * 4/1982 LeSage ..... 312/245
4,480,744 A * 11/1984 Blackmon ..... 206/1.7
4,637,322 A * 1/1987 Hampshire et al. ..... 108/102
4,765,470 A * 8/1988 Curci ..... 206/315.11
5,447,366 A 9/1995 Cole
5,695,264 A * 12/1997 Koch ..... 312/310
D393,542 S * 4/1998 Thompson ..... D3/294
5,749,636 A * 5/1998 Boury ..... 312/201
5,787,626 A 8/1998 Bingham et al.
6,213,577 B1 * 4/2001 Rooyakkers et al. ..... 312/265.3
6,361,130 B1 * 3/2002 Kardy ..... 312/245
2004/0045914 A1 3/2004 Sells et al.

FOREIGN PATENT DOCUMENTS

DE 94 04 456 5/1994

* cited by examiner

*Primary Examiner*—James O Hansen
(74) *Attorney, Agent, or Firm*—R. Neil Sudol; Henry D. Coleman; William J. Sapone

(57) ABSTRACT

A cabinet particularly for firearms, having two half-shells that are mutually articulated so as to define a closed position and an open position. Each half-shell has a transparent panel that allows to view the contents when the half-shells are in the open position.

8 Claims, 5 Drawing Sheets

CABINET PARTICULARLY FOR FIREARMS

BACKGROUND OF THE INVENTION

1. Field of the Invention

The present invention relates to a cabinet particularly for firearms.

2. Description of the Prior Art

It is known to store firearms in cabinets, armored cabinets or safes for obvious security reasons.

Conventional cabinets are bulky and heavy and do not allow to display the firearms as instead occurs with display cabinets, which however offer no protection.

The aim of the present invention is to provide a cabinet particularly for firearms that overcomes the drawbacks of the cited background art.

A particular object of the invention is to provide a cabinet that is capable of providing two functions: security in firearms storage and visibility of the contents.

Another object of the invention is to provide a cabinet that can be styled for use also as an item for interior decoration.

Another object is to provide a cabinet that can be transported easily and is easy to install and use.

SUMMARY OF THE INVENTION

This aim and these and other objects that will become better apparent hereinafter are achieved by a cabinet particularly for firearms, comprising at least two half-shells, which are mutually articulated so as to define at least one closed position and at least one open position in which the half-shells allow to view the contents.

BRIEF DESCRIPTION OF THE DRAWINGS

Further characteristics and advantages of the present invention will become better apparent from the following detailed description of preferred but not exclusive embodiments thereof, illustrated by way of nonlimiting example in the accompanying drawings, wherein.

DESCRIPTION OF THE PREFERRED EMBODIMENTS OF THE INVENTION

Figure 1:
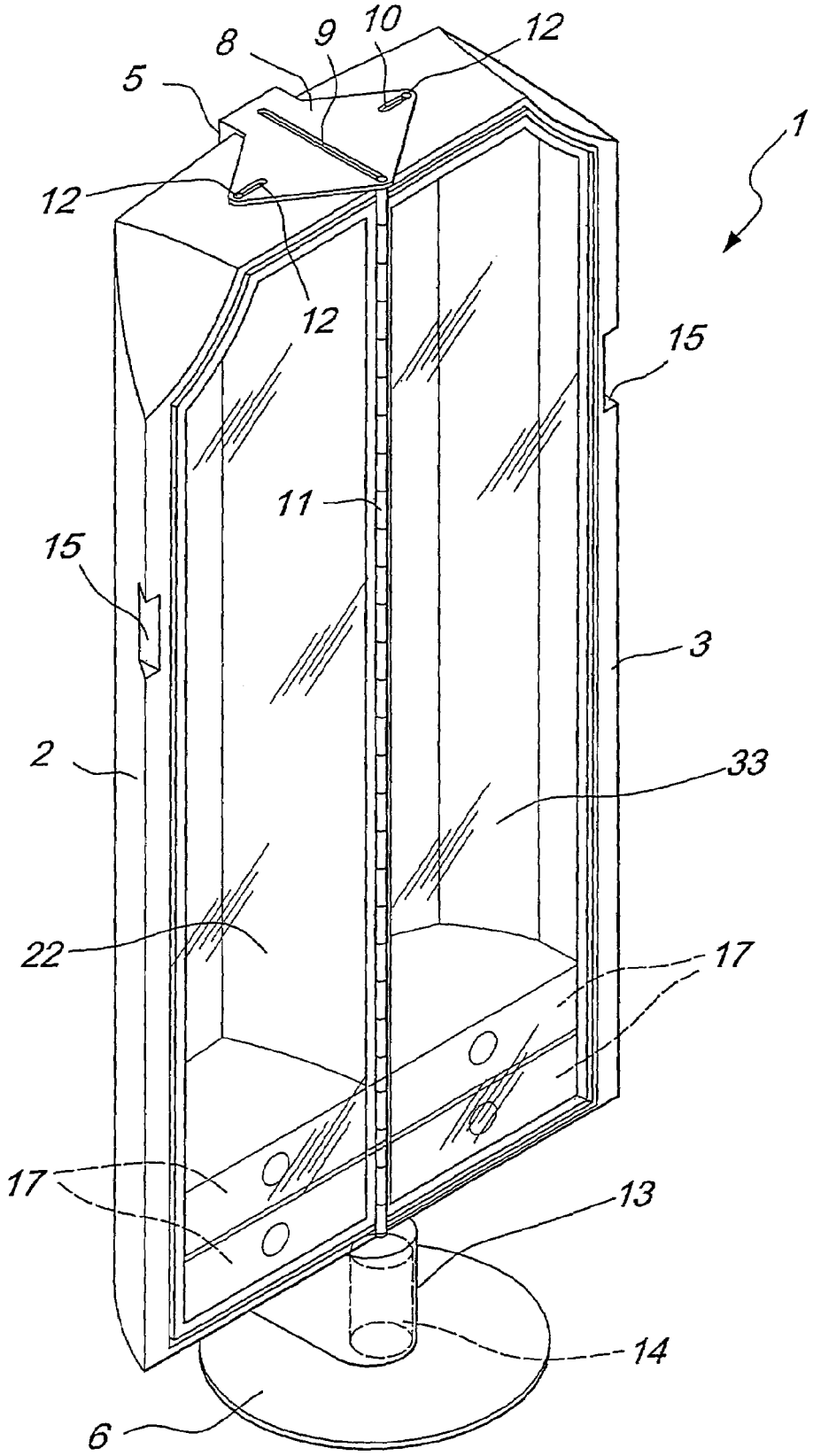
FIG. 1 is a perspective view of the cabinet according to the invention, shown in the open position.
Figure 2:
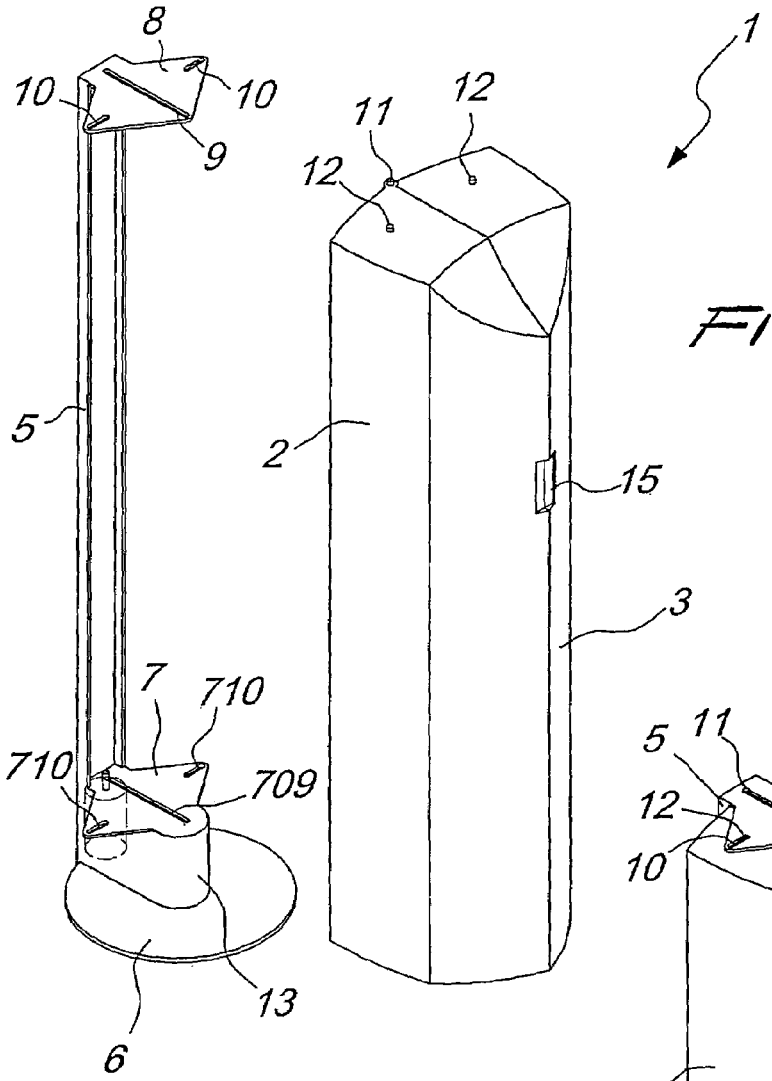
FIG. 2 is an exploded perspective view of the cabinet according to the invention.
Figure 3:
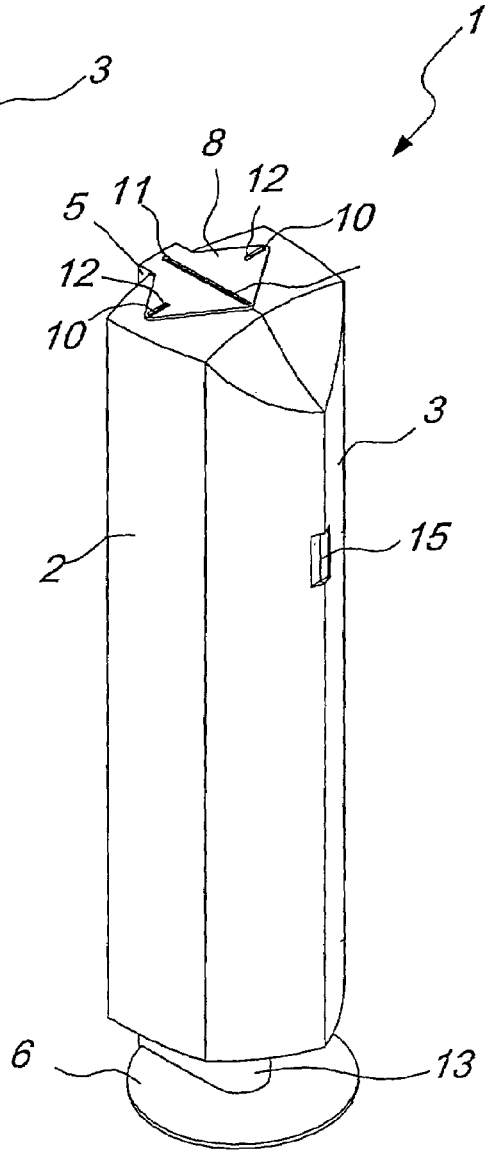
FIG. 3 is a perspective view of the cabinet according to the invention, shown in the closed position.
Figure 4:
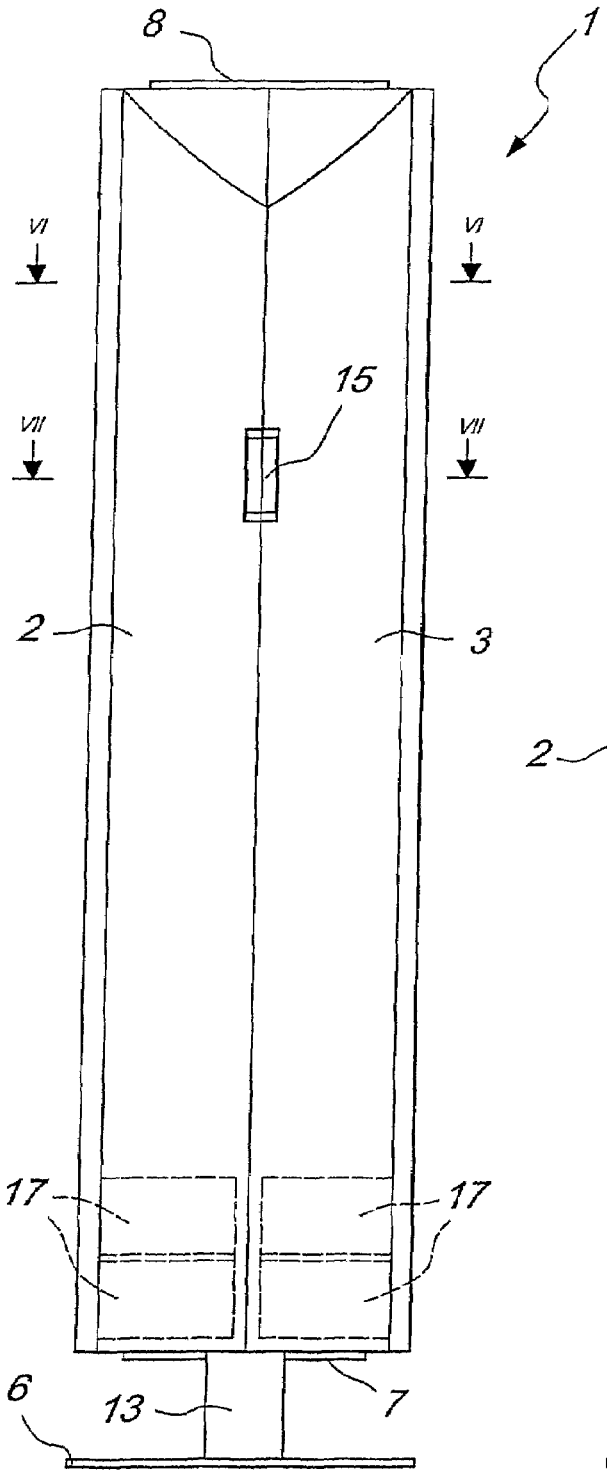
FIG. 4 is a front elevation view of the cabinet, shown in the closed position.
Figure 5:
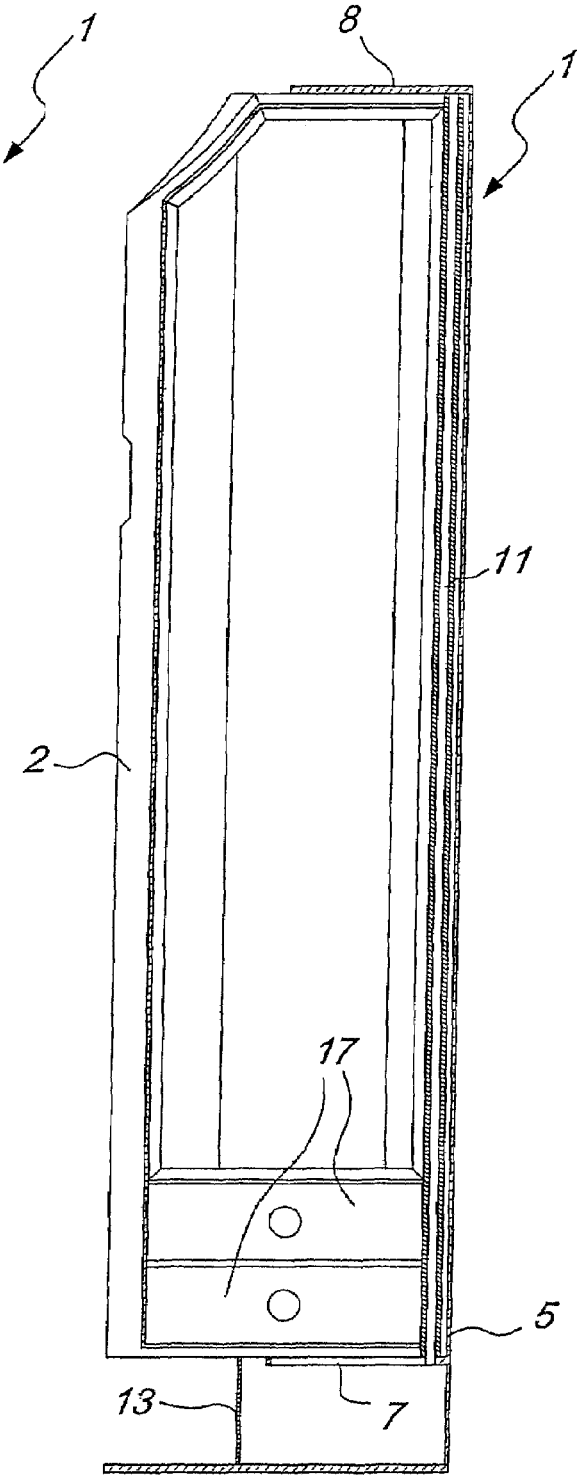
FIG. 5 is a side elevation view of the cabinet, shown in the closed position.
Figure 6:
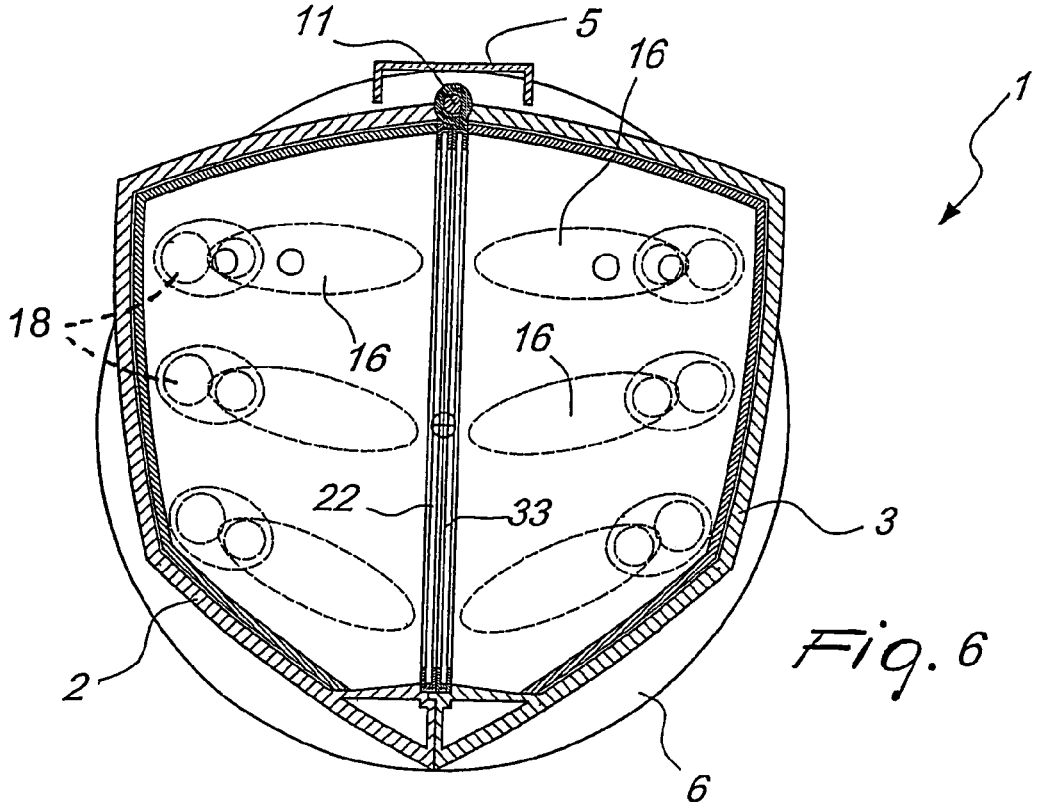
FIG. 6 is a sectional view, taken along the line VI-VI of FIG. 4.
Figure 7:
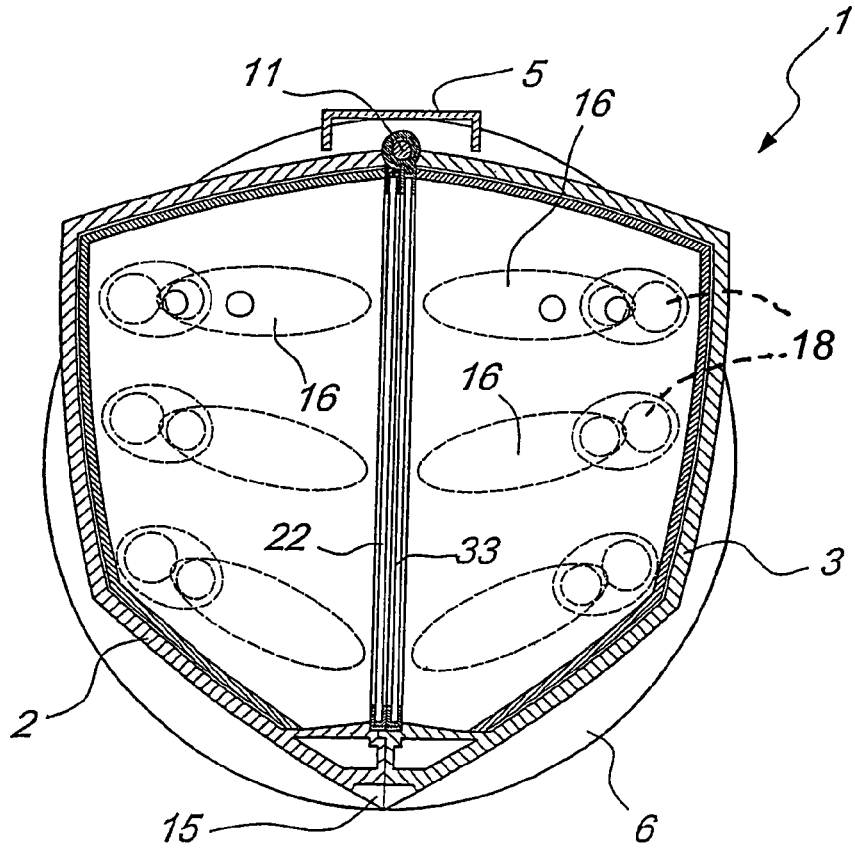
FIG. 7 is a sectional view, taken along the line VII-VII of FIG. 4.
Figure 8:
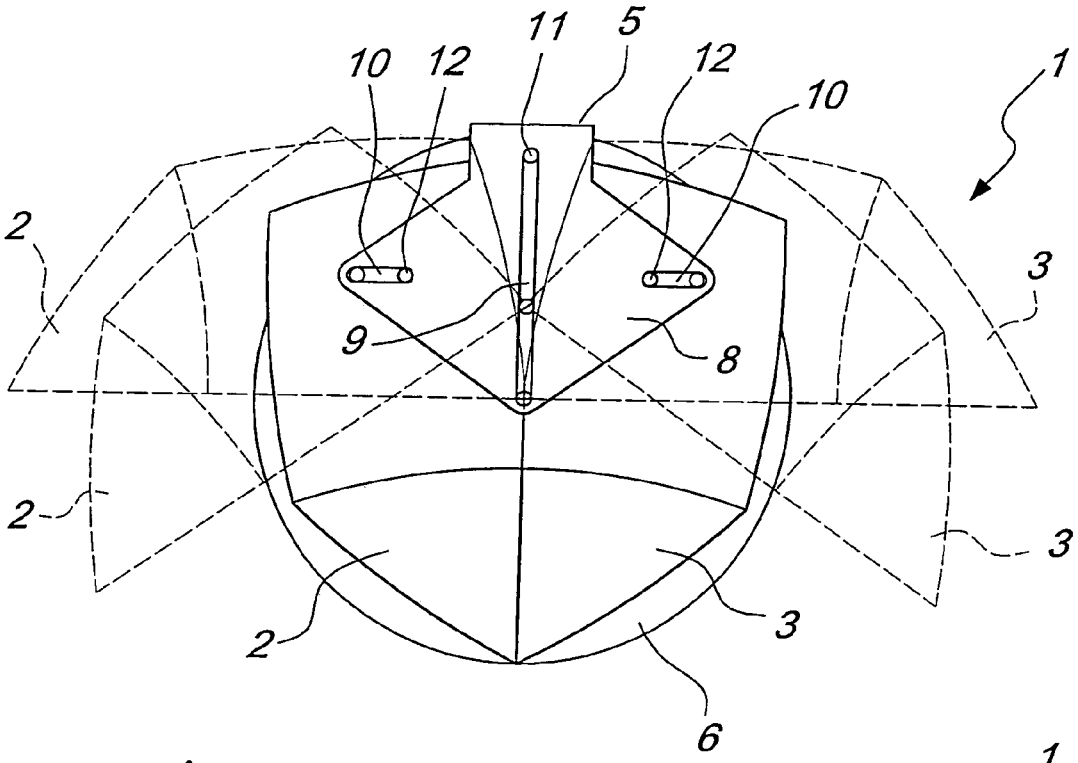
FIG. 8 is a plan view of the cabinet according to the invention, shown in the closed position.
Figure 9:
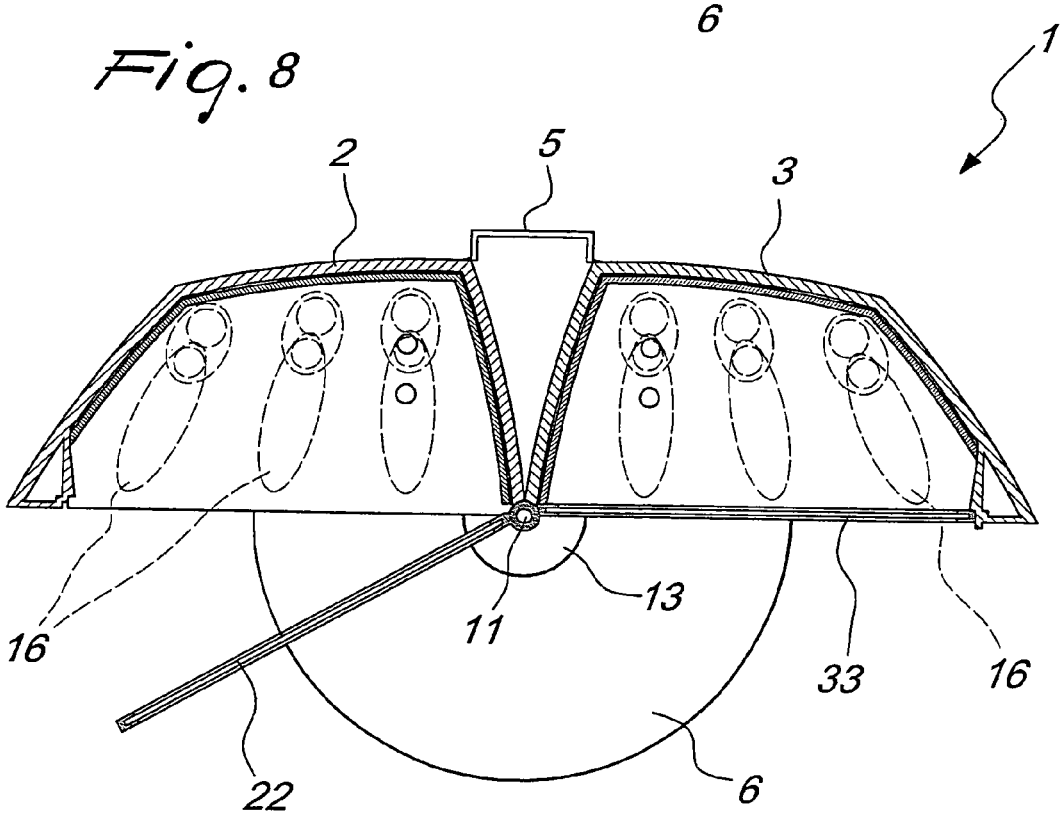
FIG. 9 is a plan view of the cabinet according to the invention, shown in the open position.

With reference to the cited figures, a cabinet according to the invention, generally designated by the reference numeral 1, comprises two half-shells, designated by the reference numerals 2 and 3 respectively, which are articulated to a support by way of a hinge means.

The support is constituted by a post 5, which is associated with a supporting base 6 and is provided with a lower plate 7 and with an upper plate 8, which act as supports for the half-shells 2 and 3 and constitute the hinge means.

The post 5 has a fastening means for fastening the support to a wall, constituted for example by slots or holes for fastening by way of wall anchors.

The upper plate 8 is provided with a central slot 9 and with perpendicular slots 10, within which a central pivot 11 and lateral pivots 12 associated with the half-shells can slide respectively.

Likewise, the lower plate 7 is provided with a central slot 709 and with perpendicular slots 710, in which the central pivot 11 and the lateral pivots 12 associated with the half-shells can slide respectively.

The central pivot 11 constitutes a hinge, which acts as a member for pivoting the edges of the half-shells 2 and 3 and of two panels, designated by the reference numerals 22 and 33 respectively, which are suitable to close the open sides of the respective half-shells.

The panels 22 and 33 are preferably made of glass or other transparent material suitable to allow viewing of the contents of the half-shells.

In the lower part of the post, below the lower plate 7, there is a casing 13 which contains a motor 14 for opening and closing the half-shells. The half-shells are provided with a lock system 15 or another break-in prevention system.

The half-shells 2 and 3 internally comprise a means 18 for supporting firearms, for example rifles 16 and/or guns, and also comprise drawers 17 in a lower region.

The cabinet according to the invention can be used, in the closed position, as an armored cabinet or safe for protecting its contents and, in the open position, as a display cabinet.

The opening of the half-shells can be motorized or manual.

In practice it has been found that the invention achieves the intended aim and objects, by providing a cabinet that allows to combine two traditionally separate functions: safety in firearm preservation and visibility of the contents.

The cabinet according to the invention can also be used as an item of interior decoration even in refined environments.

An important advantage of the cabinet according to the present invention is that it can be transported easily because it can be disassembled.

The cabinet according to the invention is susceptible of numerous modifications and variations, within the scope of the appended claims. All the details may be replaced with technically equivalent elements.

The materials used, as well as the dimensions, may of course be any according to requirements and to the state of the art.

The invention claimed is:

1. A cabinet particularly for firearms, comprising:

at least two elongate half-shells each containing means internally for supporting rifles, said half shells being mutually articulated so as to define at least one closed position and at least one open position in which said half-shells allow viewing of the rifles; and a support and a hinge means for the articulation of said half-shells to said support, said support being constituted by a post, which is associated with a supporting base and is provided with a lower plate and with an upper plate, said lower plate and said upper plate supporting said half-shells, at least one of said upper plate and said lower plate being provided with a central slot and with perpendicular slots within which a central pivot and lateral pivots associated with said half-shells can slide respectively.

2. The cabinet according to claim 1, comprising a motor means suitable to actuate the opening and closure of said half-shells.

3. The cabinet according to claim 1, comprising a lock means for security closure of said half-shells.

4. The cabinet according to claim 1, wherein said upper plate is provided with said central slot and with said perpendicular slots within which said central pivot and said lateral pivots associated with said half-shells can slide respectively.

5. The cabinet according to claim 4, wherein said central pivot constitutes a hinge that acts as a member for pivoting the edges of said half-shells to close the open sides of the respective half-shells.

6. The cabinet according to claim 1, wherein said lower plate is provided with said central slot and with said perpendicular slots within which said central pivot and said lateral pivots associated with said half-shells can slide respectively.

7. The cabinet according to claim 1, wherein said half-shells internally comprise drawers.

8. A cabinet particularly for firearms, comprising:

at least two elongate half-shells each containing means internally for supporting rifles, said half shells being mutually articulated so as to define at least one closed position and at least one open position in which said half-shells allow viewing of the rifles; and a support and a hinge means for the articulation of said half-shells to said support, said support being constituted by a post, which is associated with a supporting base and is provided with a lower plate and with an upper plate, said lower plate and said upper plate supporting said half-shells, further comprising a casing, in a lower part of said post, below said lower plate, which is suitable to contain a motor.

* * * * *